US007572197B2

(12) United States Patent
Chauvin et al.

(10) Patent No.: US 7,572,197 B2
(45) Date of Patent: Aug. 11, 2009

(54) MULTI-PIECE BALL BAT CONNECTED VIA A FLEXIBLE JOINT

(75) Inventors: Dewey Chauvin, Simi Valley, CA (US); Hsing-Yen Chuang, Studio City, CA (US); William B. Giannetti, Winnetka, CA (US); Gary W. Filice, Moorpark, CA (US); James Easton, Los Angeles, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/324,796

(22) Filed: Jan. 3, 2006

(65) Prior Publication Data

US 2007/0155546 A1 Jul. 5, 2007

(51) Int. Cl.
*A63B 59/06* (2006.01)

(52) U.S. Cl. ..... 473/567; 473/566; 473/520

(58) Field of Classification Search ..... 473/564–568, 473/457, 519, 520
See application file for complete search history.

(56) References Cited

U.S. PATENT DOCUMENTS

| | | | | |
|---|---|---|---|---|
| 2,031,161 | A | 2/1936 | Hamel | |
| 3,246,894 | A | 4/1966 | Salisbury | |
| 3,830,496 | A | 8/1974 | Reizer | |
| 3,877,698 | A | 4/1975 | Volpe | |
| 3,921,976 | A | 11/1975 | Lane | |
| 4,399,996 | A | 8/1983 | Boyce | |
| 4,555,111 | A | 11/1985 | Alvarez | |
| 4,772,021 | A | 9/1988 | Maynard | |
| 4,940,247 | A | 7/1990 | Magadini | |
| 4,951,948 | A | 8/1990 | Peng | |
| 5,131,651 | A | 7/1992 | You | |
| 5,219,164 | A | 6/1993 | Peng | |
| 5,303,917 | A | 4/1994 | Uke | |
| 5,338,035 | A | 8/1994 | Lyford | |
| 5,409,214 | A | 4/1995 | Cook | |
| 5,516,097 | A | 5/1996 | Huddleston | |
| 5,593,158 | A | 1/1997 | Filice et al. | |
| 5,711,728 | A | 1/1998 | Marcelo | |
| 5,833,561 | A | 11/1998 | Kennedy et al. | |
| 6,022,282 | A | 2/2000 | Kennedy et al. | |
| 6,050,908 | A | 4/2000 | Muhlhausen | |
| 6,056,655 | A | 5/2000 | Feeney et al. | |
| 6,432,006 | B1 | 8/2002 | Tribble | |
| 6,461,260 | B1 | 10/2002 | Higginbotham | |
| 6,485,382 | B1 | 11/2002 | Chen | |
| 6,511,392 | B1 | 1/2003 | Chohan | |
| 6,625,848 | B1 * | 9/2003 | Schneider | 16/436 |
| 6,743,127 | B2 | 6/2004 | Eggiman et al. | |
| 6,783,471 | B2 * | 8/2004 | Bolduc et al. | 473/457 |
| 6,863,628 | B1 * | 3/2005 | Brandt | 473/520 |
| 6,929,573 | B1 | 8/2005 | Chang | |
| 7,097,578 | B2 * | 8/2006 | Guenther et al. | 473/567 |

(Continued)

*Primary Examiner*—Mark S Graham
(74) *Attorney, Agent, or Firm*—Perkins Coie LLP; Rodger K. Carreyn

(57) ABSTRACT

A multi-piece ball bat includes a first section including a hitting portion, and a second section including a handle portion. A flexible joint connects the first section to the second section. The flexible joint may be a structural joint, such as a spring member, a mechanical locking joint, or a pneumatic or hydraulic joint, or it may be a non-uniform and/or non-continuous elastomeric joint.

12 Claims, 5 Drawing Sheets

U.S. PATENT DOCUMENTS

| | | | | |
|---|---|---|---|---|
| 7,128,670 | B2 * | 10/2006 | Souders et al. | 473/567 |
| 2004/0224803 | A1 * | 11/2004 | Forsythe et al. | 473/564 |
| 2005/0221924 | A1 * | 10/2005 | Sutherland et al. | 473/564 |
| 2006/0025251 | A1 * | 2/2006 | Giannetti et al. | 473/564 |
| 2006/0025252 | A1 * | 2/2006 | Giannetti et al. | 473/564 |
| 2006/0252586 | A1 * | 11/2006 | Nguyen | 473/564 |

* cited by examiner

FIG. 3A
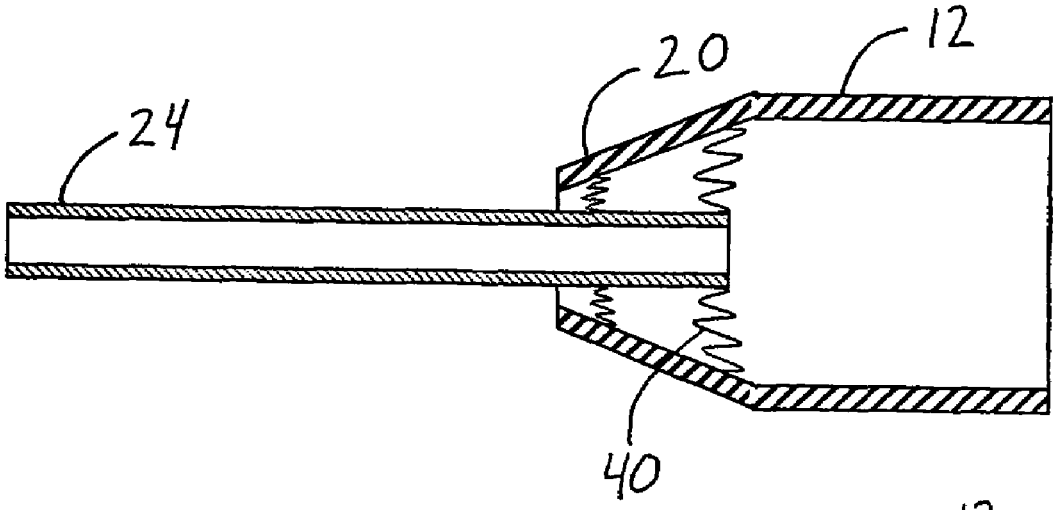
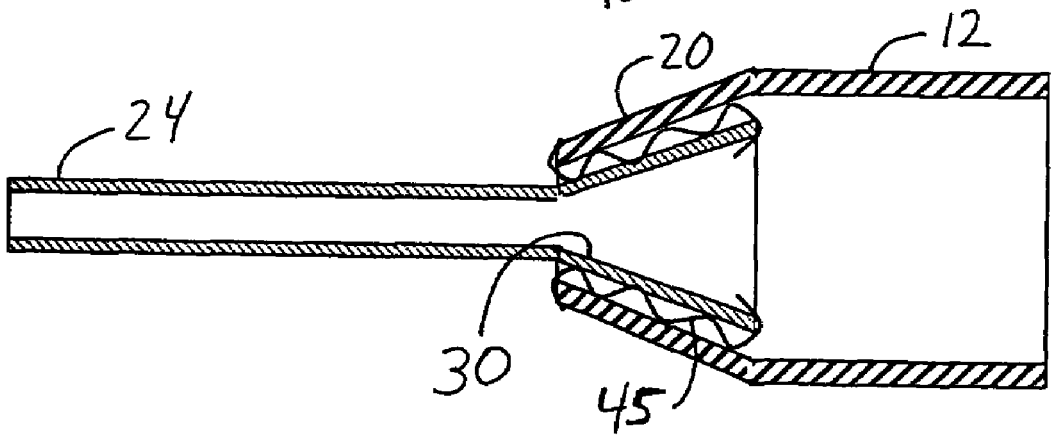
FIG. 3B

FIG. 4A
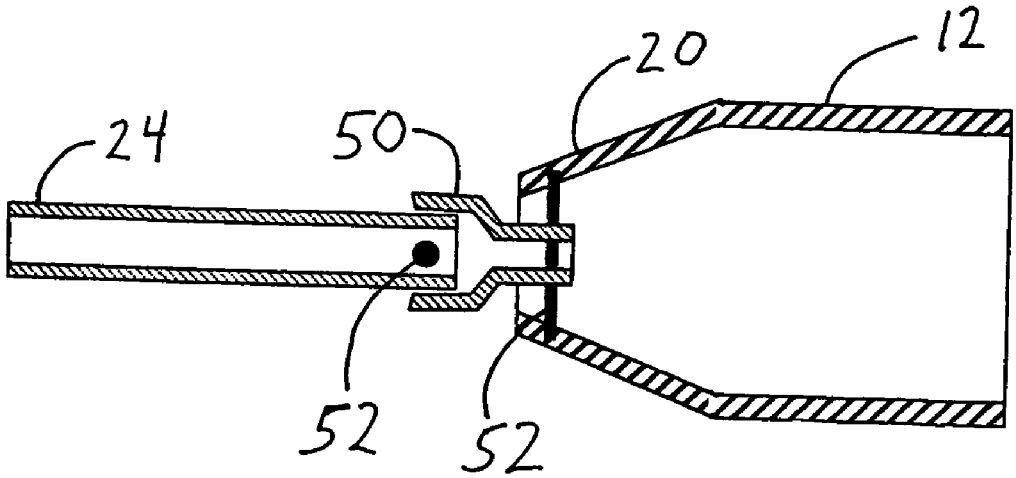
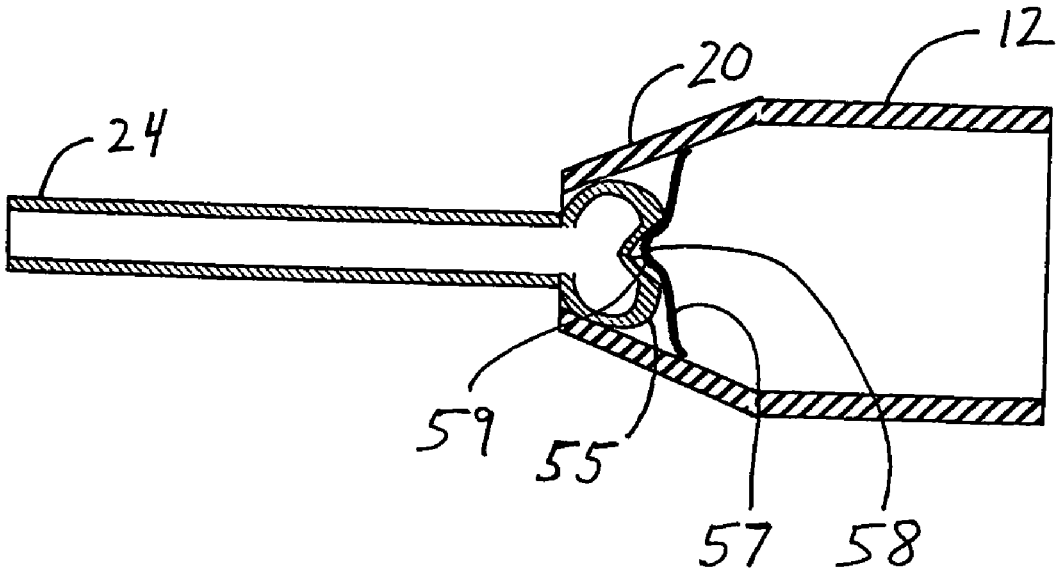
FIG. 4B

FIG. 5A
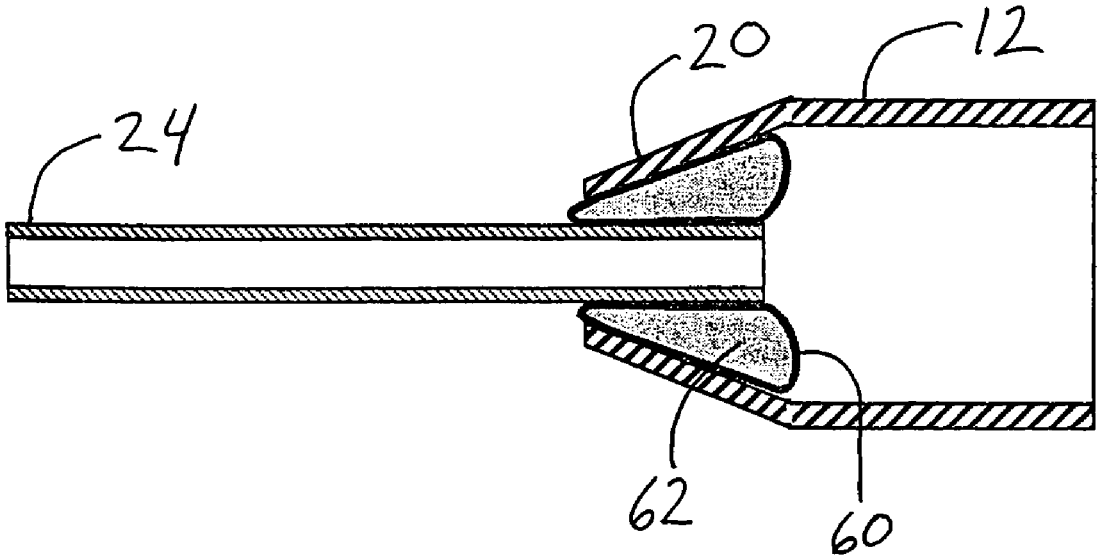
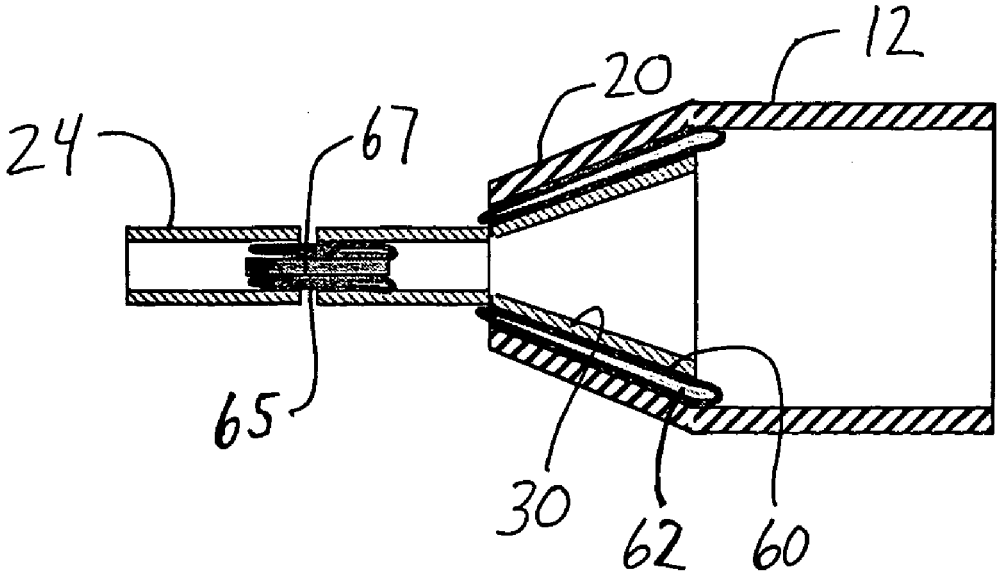
FIG. 5B

FIG. 6A
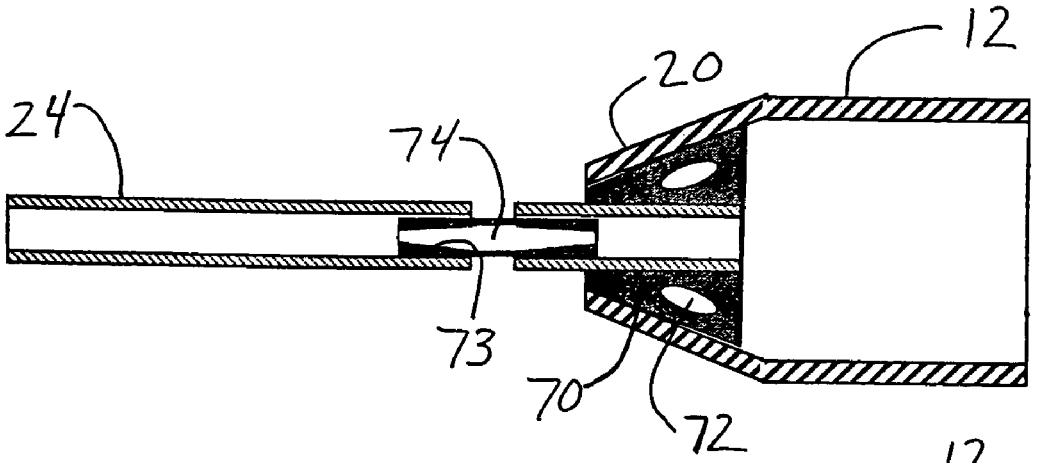
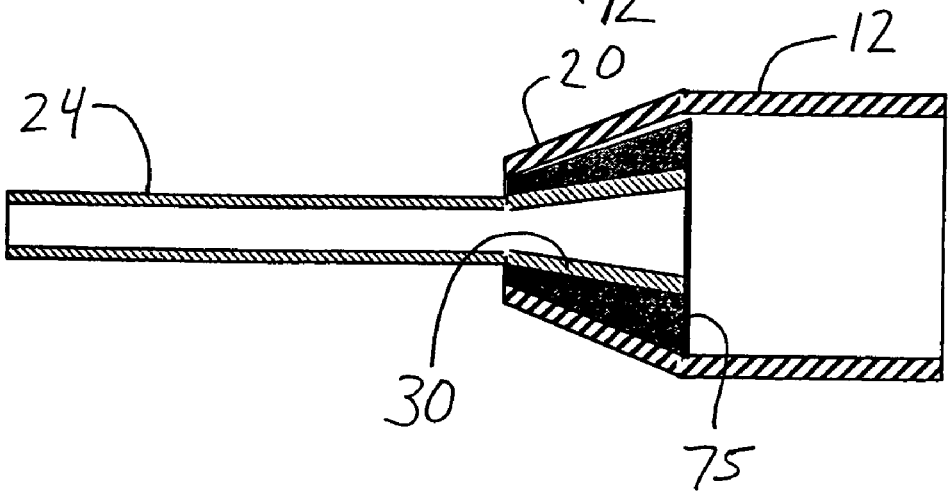
FIG. 6B

MULTI-PIECE BALL BAT CONNECTED VIA A FLEXIBLE JOINT

BACKGROUND

Two-piece or multi-piece ball bats were designed to reduce shock transmitted to a batter's hands during an "off-center," or "non-sweet spot," hit. A two-piece ball bat including a handle section joined to a barrel section via an elastomeric isolation union, for example, is described in U.S. Pat. No. 5,593,158, which is incorporated herein by reference. The elastomeric isolation union is located between, and bonded to, an outer surface of the handle section and an inner surface of the barrel section. The incorporation of an elastomeric isolation union at an axial location above where a batter typically grips the ball bat provides significant attenuation of shock waves that result from off-center hits, and that would otherwise be transmitted to the batter's hands.

While existing two-piece ball bats have been successful at attenuating shock, most two-piece bat designs have focused strictly on this shock attenuation feature. The two-piece bat concept, however, provides an opportunity to tailor several additional features of a ball bat, such as the feel and flexibility of the ball bat.

SUMMARY

A multi-piece ball bat includes a first section including a hitting portion, and a second section including a handle portion. A flexible joint connects the first section to the second section. The flexible joint may be a structural joint, such as a spring member, a mechanical locking joint, or a pneumatic or hydraulic joint, or it may be a non-uniform and/or non-continuous elastomeric joint.

Other features and advantages of the invention will appear hereinafter. The features of the invention described above can be used separately or together, or in various combinations of one or more of them. The invention resides as well in subcombinations of the features described. Furthermore, many of the method steps described herein may be performed in a different order than that which is explicitly described.

BRIEF DESCRIPTION OF THE DRAWINGS

In the drawings, wherein the same reference number indicates the same element throughout the several views:

FIG. 3A is a sectional view of a transition region of a ball bat including a flexible spring joint.

FIG. 3B is a sectional view of a transition region of a ball bat including an alternative flexible spring joint.

FIG. 4A is a sectional view of a transition region of a ball bat including a pin joint.

FIG. 4B is a sectional view of a transition region of a ball bat having a flexible joint including an axial locking member engaged with a realignment spring.

FIG. 5A is a sectional view of a transition region of a ball bat including a pneumatic or hydraulic joint.

FIG. 5B is a sectional view of a transition region of a ball bat including an alternative pneumatic or hydraulic joint.

FIG. 6A is a sectional view of a transition region of a ball bat including a non-uniform, non-continuous elastomeric joint.

FIG. 6B is a sectional view of a transition region of a ball bat including a non-uniform elastomeric joint.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

While two-piece ball bats, such as those described in U.S. Pat. No. 5,593,158, are effective at reducing shock, many batters also find that these bats exhibit excellent "feel" during swinging and ball striking. This is likely due to the added bat flexibility provided by the elastomeric isolation union. Thus, while the original intent behind designing a two-piece ball bat was to provide shock attenuation, it has been discovered that other benefits may arise from such a bat construction. Innovative two-piece (or multi-piece) ball bats, utilizing a variety of flexible joint configurations, as well as a judicious selection of joint and bat materials, to provide increased bat flexure and improved bat feel, are described below.

Figure 1:
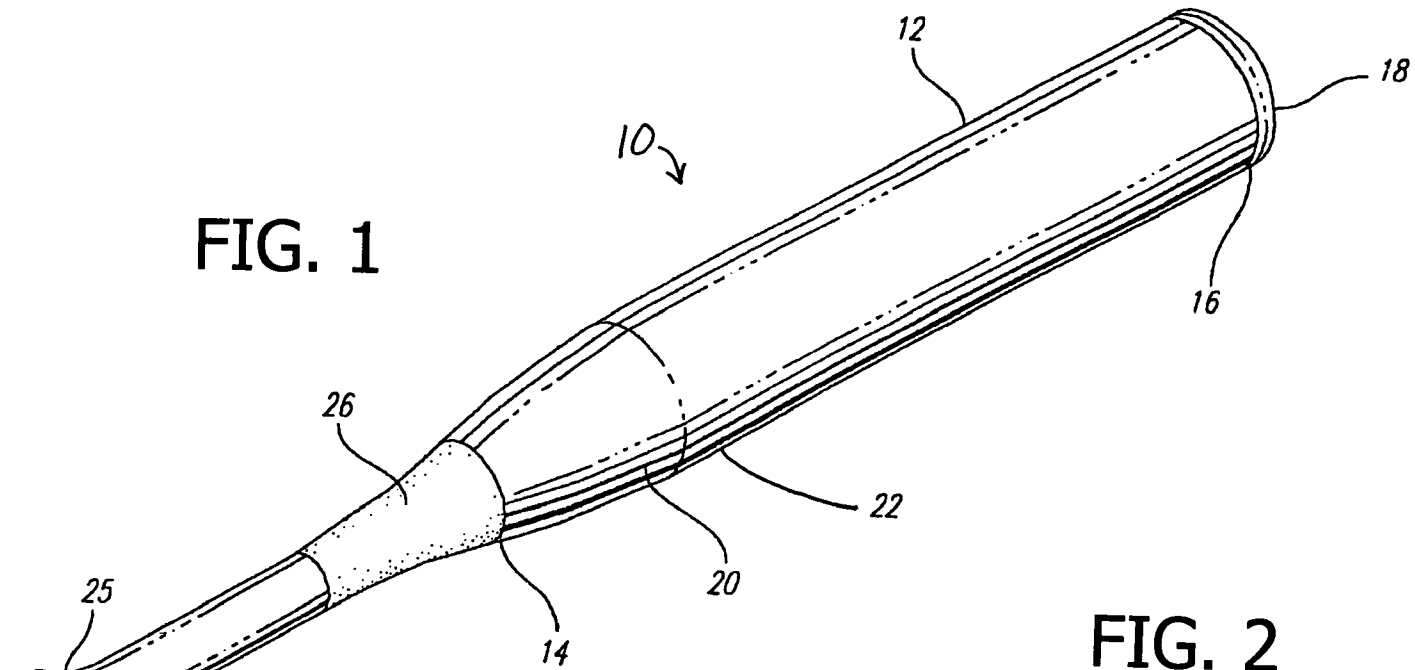
FIG. 1 is a perspective view of a ball bat according to one embodiment.
Figure 2:
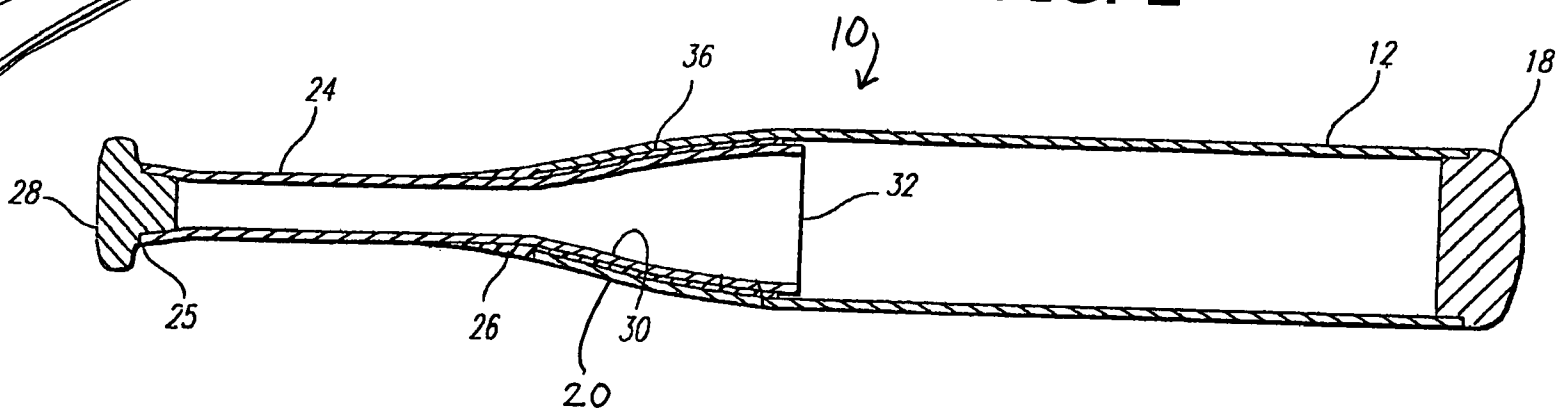
FIG. 2 is a sectional view of the ball bat of FIG. 1.

FIGS. 1 and 2 illustrate one embodiment of a ball bat 10 including a barrel 12 having a proximal end 14 and a distal end 16 closed by an end closure, such as an end cap 18. The end cap 18 may be attached via press fit or adhesive, or by threading, pinning, or by another suitable method. The end closure may alternatively be a roll over, for example, or any other suitable closure.

The barrel includes a barrel taper segment 20 having a distal region 22 where the barrel transitions from a substantially frusto-conical configuration to a more generally cylindrical configuration, and a proximal end (which in the illustrated embodiment substantially corresponds with the proximal end 14 of the barrel 12) terminating at a transition region 26. The configuration of the barrel 12 may be modified, as desired, to incorporate greater or lesser taper.

The ball bat 10 further includes a handle 24 beginning at a proximal end 25 and extending into (and optionally beyond) the barrel taper segment 20. The transition region 26 preferably provides a continuous transition between the handle 24 and the barrel taper segment 20, thus yielding an integral bat shape with a smooth outer contour. A knob 28 is attached to the proximal end 25 of the handle 24 via welding, or via another suitable connection, for example, via a threaded or pinned connection. The knob 28 may alternatively be unitary or otherwise integrated with the handle 24.

The diameter of the handle 24 may be uniform, or substantially uniform, throughout its axial length, as illustrated in FIGS. 3A, 4A, 5A, and 6A. Alternatively, as illustrated in FIGS. 2, 3B, 4B, 5B, and 6B, the handle 24 may include a tapered or enlarged interference segment 30 extending into (and optionally beyond) the barrel taper segment 20. The handle interference segment 30 may have any suitable configuration. It may, for example, include one or more radially extending projections or flanges (not shown in the drawings) for preventing the handle 24 from sliding out of the proximal end 14 of the barrel 12. The inner surface of the barrel 12 or the barrel taper segment 20 may have any suitable configuration that is compatible or complementary with the outer surface of the handle 24 or the handle interference segment 30.

A flexible connecting joint 36 connects the handle 24 to the barrel 12, and preferably isolates them to allow relative movement between the handle 24 and the barrel 12. The flexible connecting joint 36 may optionally be the only connection between the handle 24 and the barrel 12, or the handle 24 and the barrel 12 may be connected to each other by additional means, or at one or more additional locations. For example, multiple flexible connecting joints 36 may optionally be included to connect the handle 24 and barrel 12 in one or more regions of the ball bat 10.

The flexible connecting joint 36 is preferably located between an inner surface of the barrel taper segment 20 and an outer surface of the handle 24 or handle interference segment 30. The flexible connecting joint 36 may, however, be located anywhere between the grip region of the handle 24 and the distal end of the barrel 12, preferably between the grip region and the center of percussion of the ball bat 10. For example, the flexible connecting joint 36 may be located partially or entirely within the handle region of the ball bat, or within the barrel region just beyond the tapered section of the ball bat, or at or distal to the center of percussion of the ball bat 10, or in any other suitable location.

The center of percussion, also referred to as the center of oscillation, of the ball bat 10 is readily determinable by those skilled in the art. For example, ASTM F2398-04e1 defines a standard test method for measuring the center of percussion of a baseball or softball bat. When impact occurs at or near the bat's center of percussion, reactions are not induced at the pivot point of the ball bat, which is typically located approximately six inches from the proximal end of the ball bat 10. Accordingly, little or no vibration is felt by a batter when such impact occurs.

The elastomeric isolation union described in U.S. Pat. No. 5,593,158 is bonded to the handle and barrel of a ball bat to provide shock attenuation. Illustrated in FIGS. 2-6, and described below, are a variety of flexible connecting joints that provide a substantial drop in stiffness across the joints relative to the surrounding handle 24 or barrel 12 sections. These joints allow the barrel 12 or upper handle sections to flex relative to the grip portion of the handle 24. While any of the flexible connecting joints described herein may also act as a shock attenuator, they are preferably flexure joints that provide improved bat performance and feel.

FIGS. 3A and 3B illustrate embodiments in which one or more mechanical spring members connect the bat handle 24 to the bat barrel 12. In FIG. 3A, one or more compression or tension springs 40 are interposed between, and connected to, a cylindrical handle 24 (the handle 24 could alternatively include a tapered or enlarged segment) and a barrel taper segment 20. In FIG. 3B, one or more leaf springs 45 are interposed between, and connected to, a handle taper segment 30 (the handle 24 could alternatively have a uniform, or substantially uniform, diameter) and a barrel taper segment 20. The gap between the barrel taper segment 20 and the handle 24 or handle taper segment 30 may or may not be substantially constant or uniform.

Any suitable spring types, such as spiral, leaf, tension, or compression springs, may be used. Moreover, any suitable number of springs, for example, three leaf springs, a one-piece compression spring, or any suitable number or combination of spring types, may be used. The number, size, and thickness of the one or more springs used may be varied to provide desired durability or weight. The springs may be welded, mechanically attached, bonded, or otherwise suitably connected at the spring ends to prevent the handle 24 and the barrel 12 from disassembling. Additional attachment features, such as mechanical elements or adhesive, may optionally be included to increase durability.

The one or more springs may be made of any suitable materials. For example, the one or more springs may be made of one or more metal alloys, including but not limited to steel, beryllium-copper, or brass, or one or more plastic materials, including but not limited to nylon, polycarbonate, or PVC (polyvinyl chloride), or one or more composite materials, including but not limited to carbon, glass, or Kevlar® (poly-paraphenylene terephthalamide).

The spring joint facilitates relative motion between the barrel 12 and the handle 24, and provides restoring force to realign the handle 24 and the barrel 12 during or after swinging of the ball bat 10. The force present in the springs may be selected to meet the needs of a given user. For example, one or more springs providing a relatively low force may be selected for youth players or other light-swinging players, while one or more springs providing a relatively high force may be selected for skilled players or other hard-swinging players.

FIGS. 4A and 4B illustrate embodiments in which mechanical locking joints are used to connect the bat handle 24 to the bat barrel 12. In FIG. 4A, a connection member 50, such as a U-joint or similar member, connects a cylindrical handle 24 (the handle 24 could alternatively include a tapered or enlarged segment) to a barrel taper segment 20. Pins 52 or similar instruments may be used to attach the connection member 50 to the handle 24 and to the barrel 12, and to provide pivot locations about which the connection member 50 may pivot to provide increased bat flexure.

In FIG. 4B, an axial locking member 55, such as an enlarged spherical, conical, or partially-rounded member, is attached to, or unitary or integral with, an end of the bat handle 24 positioned inside the barrel taper segment 20. The axial locking member 55 is preferably in interference fit with an inner surface of the barrel taper segment 20, which may optionally be a low-friction bearing surface. The axial locking member 55 may optionally have a high-friction or low-friction outer surface.

A realignment spring 57 is attached to the inner surface of the barrel taper segment 20 via bonding, welding, pinning, or via another suitable method. The realignment spring 57 is in engagement with the axial locking member 55 in a manner for restoring the handle 24 and barrel 12 into axial alignment during or after swinging of the ball bat 10. For example, as shown in FIG. 4B, the realignment spring 57 may include a protruding portion 58 that engages a notch 59 in the axial locking member 55 for restoring the handle 24 and barrel 12 into axial alignment. Any other suitable alignment mechanism may alternatively be used.

Any mechanical joint that axially locks the handle 24 and barrel 12 together, and that includes a feature for restoring the handle 24 and barrel 12 into axial alignment during or after a swing, may be used to connect the handle 24 to the barrel 12.

The mechanical joint allows the barrel 12 to move relative to the handle 24, thus providing increased bat flexure. The stiffness of the joint may be selected to meet the needs a given player. For example, for harder-swinging batters, a mechanical joint with a relatively high stiffness is generally preferred to prevent the bat 10 from flexing too far out of axial alignment, which could rob the batter of desired swing control. Conversely, for lighter-swinging players, it may be desirable to incorporate a mechanical joint with a lower stiffness to provide even greater bat flexure.

FIGS. 5A and 5B illustrate embodiments in which one or more pneumatic or hydraulic joints, including bladders 60 containing air, gas, or other fluid 62 (collectively referred to herein as "fluid") under pressure, are used to connect the bat handle 24 to the bat barrel 12. In FIG. 5A, one or more pneumatic or hydraulic joints are interposed between, and bonded or otherwise connected to, a cylindrical handle 24 and a barrel taper segment 20. In FIG. 5B, one or more pneumatic or hydraulic joints are interposed between, and connected to, a handle taper segment 30 and a barrel taper segment 20. The gap between the barrel taper segment 20 and the handle 24 or handle taper segment 30 may or may not be substantially constant or uniform.

As illustrated in FIG. 5B, one or more hydraulic or pneumatic joints 65 may additionally or alternatively be used to connect handle regions extending outside of the barrel taper segment 20 to provide increased flexure or one or more flex points in the ball bat 10. A support member 67 may optionally be included along a central axis of each hydraulic or pneumatic joint 65 in the handle 24 to provide support and to maintain the desired radial thickness of the hydraulic or pneumatic joint 65.

The fluid 62 held under pressure within the one or more bladders 60 provides a gap between the barrel 12 and the handle 24, thus allowing the barrel 12 and the handle 24 to flex relative to each other. The fluid 62 may optionally be an electrorheological (active damping) fluid. Electrorheological fluids, such as lithium polymethacrylate, are suspensions of extremely fine particles in non-conducting fluids. The apparent viscosity of these fluids changes reversibly by a very high order in response to an electric field, which can increase the damping characteristics of the hydraulic or pneumatic joints. For example, a typical electrorheological fluid can go from the consistency of a liquid to that of a gel, and back, with response times on the order of milliseconds.

The stiffness of the one or more hydraulic or pneumatic joints may be altered by varying the pressure of the fluid contained in the one or more bladders 60. Additionally or alternatively, the one or more bladders 60 may be provided with internal reinforcement webbing to increase the axial or radial stiffness, as well as the axial strength, of the bladders 60. The bladders 60 may be made of any suitable material, such as a rubber or plastic material.

In one embodiment, active damping of the ball bat may be controlled by coupling one or more bladders 60 containing electrorheological fluid with a piezoelectric device and a signal conditioner or amplifier. In this manner, the electrorheological fluid may be tuned to offer desired stiffness in response to specific vibration signals sensed by the piezoelectric device. A signal conditioner or similar device may be used to filter the piezoelectric device's signals to tune the material stiffness such that vibration modes (which can be painful to a batter's hands) in a range of approximately 100-1000 Hz are eliminated.

The flexible connecting joints illustrated in FIGS. 3-5 are structural joints including a defined physical structure, as opposed to the uncontained elastomeric isolation union described in U.S. Pat. No. 5,593,158. These structural joints include several features, and allow for additional design options, not available when using a continuous, uniform elastomeric isolation union to bond the bat handle to the bat barrel.

The term "structural" joint, as used herein, refers to a joint having sturdy, physical components, as opposed to a purely adhesive material or similar material acting as a joint. The bladder in a pneumatic or hydraulic joint, for example, is a structural component (even if it is made of an elastomeric material), since the bladder is sturdy and contains fluid under pressure, and is attached or bonded to the handle and barrel using separate bonding or attachment elements.

FIGS. 6A and 6B illustrate non-continuous and/or non-uniform (in shape or thickness) elastomeric joints, or other compliant joints, connecting a bat handle 24 to a bat barrel 12. These elastomeric or compliant joints do not include defined physical components, and are therefore considered to be non-structural joints. In FIG. 6A, one or more non-uniform, non-continuous elastomeric joints 70 are interposed between, and bonded or otherwise connected to, a cylindrical handle 24 (the handle 24 could alternatively include a tapered or enlarged segment) and a barrel taper segment 20. The elastomeric joint 70 itself may optionally be an adhesive material for connecting the handle 24 to the barrel 12. The non-continuous elastomeric joint 70 includes one or more hollow sections or voids 72, which may occupy approximately 5% to 90%, or 10% to 50%, or 20% to 35%, or at least 10%, of the total volume of the elastomeric joint 70.

As illustrated in FIG. 6A, one or more non-uniform, non-continuous elastomeric joints 73, including one or more voids 74, may additionally or alternatively be used to connect handle regions extending outside of the barrel taper segment 20 to provide increased flexure or one or more additional flex points in the ball bat 10. Each non-continuous elastomeric joint 70, 73 may optionally be applied to the handle 24 or barrel taper segment 20 (or other barrel region) as one or more non-continuous strips of elastomeric material, such as a castable urethane material or other suitable elastomer.

In FIG. 6B, one or more elastomeric joints 75 having a non-uniform thickness are interposed between, and connected to, a handle taper segment 30 (the handle 24 could alternatively have a uniform, or substantially uniform, diameter) and a barrel taper segment 20. The gap between the barrel taper segment 20 and the handle taper segment 30 or handle 24, and thus the thickness of the elastomeric layer or joint 75, varies along the axial length of the elastomeric joint 75. Such a non-uniform, or tapered, elastomeric joint 75 provides additional bat flexure without reducing the bond area or axial strength of the elastomeric joint 75.

Any of the flexible connecting joints described herein may be used alone or in combination with one or more of the other flexible connecting joints. In one embodiment, one or more flexible connecting joints are primarily positioned in the tapered region of the ball bat, which typically coincides with the fundamental vibrational anti-node (location of maximum deflection) of the ball bat. One or more flexible connecting joints may, however, be positioned anywhere between the grip region of the handle and the distal end of the ball bat, and may overlap two or more regions of the ball bat.

The optional use of a handle including a tapered or otherwise enlarged internal segment provides increased safety, by preventing the barrel from sliding off the handle, due to the overlapping fit between the handle and the barrel of the ball bat. The redundancy of this interference fit, in combination with the flexible connecting joint, is particularly advantageous for skilled or hard-swinging players who typically impact a ball with high energy.

The ball bat described herein may have any suitable length, diameter, or other dimensions. Additionally, the bat barrel may be a single-wall or a multi-wall structure. If it is a multi-wall structure, the barrel walls may optionally be separated by one or more interface shear control zones (ISCZs), as described in detail in U.S. patent application Ser. No. 10/903,493, filed Jul. 29, 2004, which is incorporated herein by reference.

The one or more structural barrel walls, as well as the handle and tapered region, are preferably made up of one or more composite plies. The composite materials that make up the plies are preferably fiber-reinforced, and may include fibers of glass, graphite, boron, carbon, aramid, ceramic, metallic, or any other suitable structural fibrous materials, preferably in epoxy form or another suitable form. Each composite ply preferably has a thickness of approximately 0.002 to 0.060 inches, or 0.005 to 0.008 inches. Any other suitable ply thickness may alternatively be used.

The one or more structural barrel walls, as well as the handle and tapered region, may alternatively be made of one or more metals, such as aluminum alloy. Combinations of one or more composite materials and metals may also be used in one or more regions of the ball bat. In one embodiment, the bat barrel (or other bat region) may comprise a hybrid metallic-composite structure. For example, the barrel may include one or more walls made of composite material(s), and one or more walls made of metallic material(s). Alternatively, composite and metallic materials may be interspersed within a given barrel wall or other bat region. In another embodiment, nano-tubes, such as high-strength carbon nano-tube composite structures, may alternatively or additionally be used in the bat construction.

The ball bats described herein may be constructed via any suitable method. For example, a ball bat including one or more flexible connecting joints may be constructed using methods similar to those described in U.S. Pat. No. 5,593,158, or any other suitable method may be used. For bats including a handle with a taper segment or other enlarged segment, the handle is preferably inserted through the cap end of the barrel, before the cap or end closure is attached or formed, so that the barrel taper segment can accommodate the handle interference segment.

The one or more flexible joints may be attached to the appropriate handle or barrel regions before or after the handle is inserted through the barrel, depending on the joint type and the method of attachment or bonding. For example, in the embodiments incorporating one or more springs, the handle may be inserted through the cap end of the barrel, after which the springs may be welded or otherwise attached to the barrel or the handle. A pneumatic or hydraulic bladder, on the other hand, may be bonded to one of the handle or barrel before insertion of the handle through the barrel, and then bonded to the other respective surface once the handle and barrel reach their desired positioning and alignment.

Thus, while several embodiments have been shown and described, various changes and substitutions may of course be made, without departing from the spirit and scope of the invention. The invention, therefore, should not be limited, except by the following claims and their equivalents.

What is claimed is:

1. A multi-piece ball bat, comprising:

a barrel section including a proximal end and a distal end, with the proximal end including a tapered section;

a handle section including a proximal end and a distal end, with the distal end of the handle section including an enlarged member in contacting interference fit with an inner surface of the tapered section; and an alignment spring connected to an inner surface of the barrel section and in engagement with a distally facing end of the enlarged member for restoring the handle section and the barrel section into axial alignment.

2. The ball bat of claim 1 wherein the alignment spring is connected to an inner surface of the tapered section of the barrel section.

3. The ball bat of claim 1 further comprising a notch in the distally facing end of the enlarged member, wherein the alignment spring includes a protruding portion positioned in the notch and in engagement with the distally facing end of the enlarged member.

4. The ball bat of claim 1 wherein the inner surface of the barrel section comprises a low-friction bearing surface.

5. The ball bat of claim 4 wherein the enlarged member includes a low-friction outer surface.

6. The ball bat of claim 4 wherein the enlarged member includes a high-friction outer surface.

7. The ball bat of claim 1 wherein the alignment spring is bonded, welded, or pinned to the inner surface of the barrel section.

8. The ball bat of claim 1 wherein the handle section is not bonded to the barrel section, and the alignment spring is not positioned radially between the handle section and the barrel section.

9. A multi-piece ball bat, comprising:

a barrel section including a proximal end and a distal end;

a handle section including a proximal end and a distal end; and a bladder containing a hydraulic fluid connecting the proximal end of the barrel section to the distal end of the handle section.

10. The ball bat of claim 9 wherein the bladder is adhesively bonded to an inner surface of the barrel section and to an outer surface of the handle section.

11. The ball bat of claim 9 wherein the bladder is located at least partially in the handle section of the ball bat.

12. The ball bat of claim 9 wherein the hydraulic fluid comprises an electrorheological fluid.

* * * * *